US010105019B2

(12) United States Patent
Moore

(10) Patent No.: US 10,105,019 B2
(45) Date of Patent: Oct. 23, 2018

(54) CLEANING TOOL FOR BODY OR FACIAL PIERCINGS

(71) Applicant: Myron Jerrell Moore, Birmingham, AL (US)

(72) Inventor: Myron Jerrell Moore, Birmingham, AL (US)

( * ) Notice: Subject to any disclaimer, the term of this patent is extended or adjusted under 35 U.S.C. 154(b) by 580 days.

(21) Appl. No.: 14/713,610

(22) Filed: May 15, 2015

(65) Prior Publication Data

US 2016/0331190 A1 Nov. 17, 2016

(51) Int. Cl.
*A47K 7/00* (2006.01)

(52) U.S. Cl.
CPC ..... *A47K 7/00* (2013.01)

(58) Field of Classification Search
CPC ..... A47K 7/00
See application file for complete search history.

(56) References Cited

U.S. PATENT DOCUMENTS

| | | | | |
|---|---|---|---|---|
| 4,497,402 | A * | 2/1985 | Karos | A44C 7/00 15/210.1 |
| 4,798,216 | A * | 1/1989 | McCarty | A61C 15/041 132/321 |
| 6,042,572 | A | 3/2000 | Fowler | |
| 6,047,209 | A | 4/2000 | Denny et al. | |
| 6,146,398 | A * | 11/2000 | Satterfield | A61F 11/00 606/162 |
| 6,358,221 | B1 | 3/2002 | Waters et al. | |
| 6,595,939 | B2 | 7/2003 | Waters, Sr. et al. | |
| 7,083,602 | B1 * | 8/2006 | Jennings | A61F 11/006 604/289 |
| 9,339,349 | B2 * | 5/2016 | Pisacane | B08B 9/027 |
| 2005/0165446 | A1 | 7/2005 | Craft | |

FOREIGN PATENT DOCUMENTS

JP 2005034567 A * 2/2005

* cited by examiner

*Primary Examiner* — Leslie Deak
*Assistant Examiner* — Gabriella Burnette

(57) ABSTRACT

An exemplary cleaning tool comprises a stem 4 to which is affixed a generally cylindrical wad formed from an absorbent material and an absorbent pad that is detachably connected to the opposite end of the cylindrical wad.

3 Claims, 1 Drawing Sheet

CLEANING TOOL FOR BODY OR FACIAL PIERCINGS

BRIEF DESCRIPTION OF THE DRAWINGS

An exemplary cleaning tool is described with reference to the accompanying drawings.

DETAILED DESCRIPTION

Figure 1:
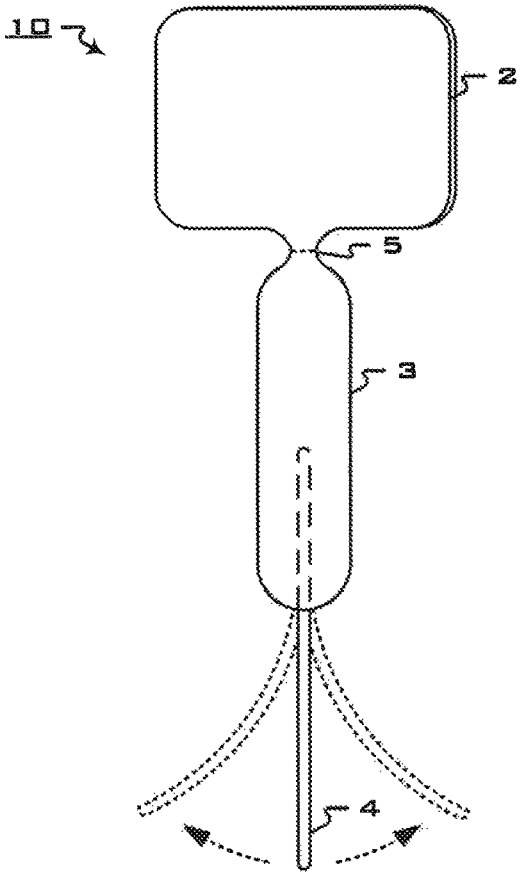
FIG. 1 depicts an exemplary cleaning tool for body or facial piercings.
Figure 2:
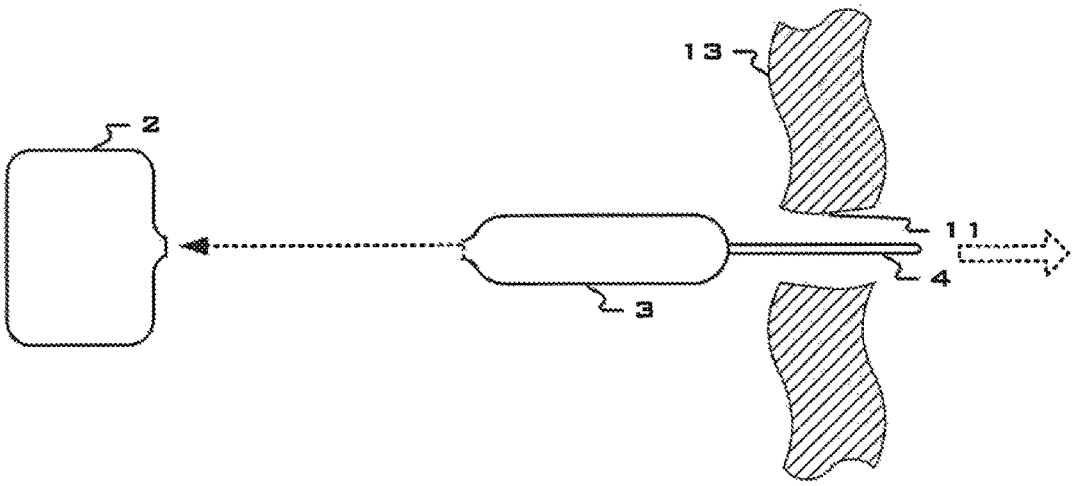
FIG. 2 illustrates use of the cleaning tool shown in FIG. 1.

The various embodiments of the cleaning tool disclosed herein and their advantages are best understood by referring to FIGS. 1 and 2. The elements of the drawings are not necessarily to scale, emphasis instead being placed upon clearly illustrating the principles of the invention.

An exemplary cleaning tool 10 is shown in FIG. 1 comprised of a relatively stiff, but flexible stem 4 having an exposed end that is rounded and blunt and an opposite end to which is affixed a generally cylindrical wad 3 formed from an absorbent material, for example, cotton, or the like. In the present embodiment, the stem 4 is formed from a flexible but resilient polymeric that tends to return to its original position after deformation, and is aligned axially with the cylindrical wad 3 and a portion of the stem 4 extends from one end of the wad 3. An absorbent pad 2, formed from, e.g., cotton, or the like, is detachably connected to the opposite end of the wad 3. In one embodiment, a perforation 5 may be interposed between the pad 2 and the end of the wad 3. Pad 2 may be any shape and may comprise a planar surface.

In one embodiment, the tool 10 may be used to clean the interior canal 11 and surrounding vicinity of a piercing in body or facial tissue 13 by first immersing the tool in a cleaning solution of the user's choice sterilizing the stem 4 and allowing both the pad 2 and the cylindrical wad 3 absorb the solution. The user may then remove the pad 2 from the wad 3 and wring out any excess solution. The user then inserts the stem 4 into one opening of the piercing and pushes the stem 4 through the piercing canal until the stem 4 emerges from the opposite opening. The user then grasps the emerging end of the stem 4 and draws the tool 10 through the piercing canal, allowing cleaning solution held within the cylindrical wad 3 to be applied to the interior surface of the piercing canal as the wad passes through. The user may optionally twist the tool 10 as it is drawn through the piercing canal to enhance the application of cleaning solution and to provide a gentle scrubbing motion to the canal surface. This process may be repeated as desired. The pad 2 may be used to apply cleaning solution to the exterior surfaces surrounding both openings of the piercing, and then the tool 10 may then be disposed of, thereafter.

As described above and shown in the associated drawings, the present invention comprises a cleaning tool for facial and body piercings. While particular embodiments have been described, it will be understood, however, that any invention appertaining to the method described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. A cleaning tool for facial and body piercing comprising:

a resilient polymeric stem having an exposed, round, blunt proximal end configured for initial insertion into a piercing opening;

a generally cylindrical wad of liquid absorbing material arranged coaxially around a distal end of said resilient polymeric stem, wherein the generally cylindrical wad is contiguous with the resilient polymeric stem and the exposed round blunt proximal end of the stem and extends from a proximal end of the generally cylindrical wad;

a planar-shaped cleaning pad formed from a liquid absorbing material and detachably connected to a distal end of said generally cylindrical wad via a perforation, wherein when the planar-shaped cleaning pad is detached from the cleaning tool, the resilient polymeric stem and the generally cylindrical wad are configured and sized to be inserted all the way through a piercing opening so that the generally cylindrical wad contacts an inside surface of the piercing opening.

2. A method of using the device of claim 1:

(a) immersing the cleaning tool into a cleaning solution (b) removing the planar-shaped cleaning pad from the distal end of said generally cylindrical wad and putting it aside for later use (c) inserting the proximal end of said resilient polymeric stem into the piercing opening (d) pushing the proximal end of said resilient polymeric stem through the piercing opening, wherein the piercing opening has a canal with a first or inserting end and a second or leaving end, until the user can grasp the proximal end of said resilient polymeric stem from the leaving or second end of the canal (e) drawing the cleaning tool completely through the canal, wherein the cleaning solution is thereby applied by the generally cylindrical wad to the canal (f) using the detached the planar-shaped cleaning pad to clean the piercing opening's external area.

3. The method of claim 2 wherein a user applies a twisting motion in order to move the cleaning tool through the canal.

* * * * *